US009449559B2

(12) United States Patent
In et al.

(10) Patent No.: US 9,449,559 B2
(45) Date of Patent: Sep. 20, 2016

(54) DISPLAY DEVICE AND DRIVING APPARATUS THEREOF

(71) Applicant: Samsung Display Co., Ltd., Yongin, Gyeonggi-Do (KR)

(72) Inventors: Hai-Jung In, Seoul (KR); Bo Yong Chung, Suwon-si (KR)

(73) Assignee: Samsung Display Co., Ltd. (KR)

( * ) Notice: Subject to any disclaimer, the term of this patent is extended or adjusted under 35 U.S.C. 154(b) by 46 days.

(21) Appl. No.: 14/617,770

(22) Filed: Feb. 9, 2015

(65) Prior Publication Data

US 2016/0104428 A1 Apr. 14, 2016

(30) Foreign Application Priority Data

Oct. 8, 2014 (KR) ..... 10-2014-0136208

(51) Int. Cl.
*G09G 3/32* (2016.01)

(52) U.S. Cl.
CPC ..... *G09G 3/3275* (2013.01); *G09G 2310/027* (2013.01); *G09G 2310/0286* (2013.01); *G09G 2310/0289* (2013.01); *G09G 2310/0291* (2013.01); *G09G 2310/0294* (2013.01); *G09G 2320/045* (2013.01)

(58) Field of Classification Search
CPC . G09G 3/3275; G09G 3/3283; G09G 3/3291
See application file for complete search history.

(56) References Cited

U.S. PATENT DOCUMENTS

| | | | | |
|---|---|---|---|---|
| 7,239,300 | B2 * | 7/2007 | Shimizu | G09G 3/3688 345/100 |
| 2004/0227713 | A1 * | 11/2004 | Sun | G09G 3/3688 345/98 |
| 2006/0244710 | A1 * | 11/2006 | Iriguchi | G09G 3/3266 345/100 |
| 2007/0109169 | A1 * | 5/2007 | Lin | G09G 3/3688 341/155 |
| 2007/0242006 | A1 * | 10/2007 | Lin | G09G 3/3225 345/82 |
| 2009/0284508 | A1 * | 11/2009 | Chen | G09G 3/3688 345/208 |
| 2010/0321367 | A1 * | 12/2010 | Shona | G09G 3/3233 345/211 |
| 2011/0157134 | A1 * | 6/2011 | Ogura | G09G 3/20 345/211 |

FOREIGN PATENT DOCUMENTS

| | | | |
|---|---|---|---|
| KR | 10-0873707 | B1 | 12/2008 |
| KR | 10-2011-0096877 | A | 8/2011 |
| KR | 10-1101554 | B1 | 1/2012 |

* cited by examiner

*Primary Examiner* — Kevin M Nguyen
(74) *Attorney, Agent, or Firm* — Innovation Counsel LLP

(57) ABSTRACT

In a data driving apparatus, a DAC converts digital data output from a holding latch into an analog data voltage. An operational amplifier operates as a buffer which outputs the analog data voltage of the DAC to the signal line during a display period and operates as a comparator which compares the voltage of the signal line with the analog data voltage of the DAC during a sensing period. In addition, a sensing controller controls the holding latch to change the data stored in the holding latch according to a comparison value of the comparator.

20 Claims, 8 Drawing Sheets

DISPLAY DEVICE AND DRIVING APPARATUS THEREOF

CROSS-REFERENCE TO RELATED APPLICATION

This application claims priority to and the benefit of Korean Patent Application No. 10-2014-0136208 filed in the Korean Intellectual Property Office on Oct. 8, 2014, the entire contents of which are incorporated herein by reference.

BACKGROUND (a) Field

The present inventive concept generally relates to a display device and a driving apparatus thereof.

(b) Description of the Related Art

An active display device such as an organic light emitting display and a liquid crystal display includes a plurality of pixels which include a plurality scan lines extending in a row direction and a plurality of data lines extending in a column direction substantially perpendicular to the plurality scan lines. A scan driving apparatus applies scan pulses to the plurality of scan lines in sequence, and a data driving apparatus applies data to the plurality of data lines to write desired data to the pixels, thereby displaying an image.

In this case, differences in luminance of the pixels may be generated due to degradation of a transistor or a light emitting element of the pixel, for example, an organic light emitting diode (OLED). To solve this problem, the display device usually adopts circuit to detect a voltage applied to the data line to determine the degree of degradation and perform compensation according to the degree of deterioration.

The display device converts the detected voltage into a digital signal by using an analog-digital converter and performs compensation based on the digital signal. In this case, there is a problem in that an area of an integrated circuit (IC) due to an analog-digital converter block is increased and thus the size of the display device is increased and manufacturing cost is increased.

SUMMARY

Embodiments of the present inventive concept provide a display device and a driving apparatus for compensating for deterioration of pixels without a separate analog-digital converter.

An embodiment of the present inventive concept provides a data driving apparatus of a display device including a signal line connected to a pixel. The data driving apparatus includes a holding latch, a digital analog converter, an operational amplifier, and a sensing controller. The holding latch stores input data, and the digital analog converter converts digital data output from the holding latch into an analog data voltage. The operational amplifier operates as a buffer which outputs the analog data voltage of the digital analog converter to the signal line during a display period and operates as a comparator which compares a voltage of the signal line with the analog data voltage of the digital analog converter during a sensing period. The sensing controller controls the holding latch to change data stored in the holding latch according to a comparison value of the comparator.

The sensing controller may control whether the operational amplifier operates as the buffer or operates as the comparator.

The holding latch may output data stored during the sensing period according to the control of the sensing controller.

The data driving apparatus may further include a sampling latch for sampling the input data transferred from a signal controller of the display device in response to the sampling signals and transferring the sampled input data to the holding latch; and a shift register sequentially transferring the sampling signals to the sampling latch.

The holding latch may output the data stored during the sensing period to the sampling latch, and the sampling latch may transfer the data received from the holding latch to the signal controller.

In this case, a path on which the sampling latch transfers the data received from the holding latch to the signal controller may be the same as a path on which the sampling latch receives the input data from the signal controller.

The holding latch may store data corresponding to the voltage of the signal line by repeating a comparing operation of the comparator and an operation of changing the data stored in the holding latch.

The sensing controller may store the data corresponding to the voltage of the signal line in the holding latch by repeating operations of selecting a bit to be set in the holding latch and setting a value of the selected bit according to the comparison value, after resetting the data stored in the holding latch as a predetermined value during the sensing period.

In this case, the sensing controller may select the bit to be set in the holding latch from a most significant bit (MSB) to a least significant bit (LSB) in sequence The data driving apparatus may further include a level down converter for down-converting the comparison value of the comparator and transferring the down-converted value to the holding latch.

The data driving apparatus may further include a level shifter for shifting a level of the data output from the holding latch and transferring the level shifted data to the digital analog converter.

Another embodiment of the present inventive concept provides a data driving apparatus of a display device including a signal line connected to a pixel. The data driving apparatus includes a holding latch, a digital analog converter, an operational amplifier, a first switching element, a second switching element, a third switching element, and a sensing controller. The holding latch stores input data, and the digital analog converter converts digital data output from the holding latch into an analog data voltage. The operational amplifier has a non-inversion terminal for receiving an output of the digital analog converter, an inversion terminal, and an output terminal. The first switching element is connected between the inversion terminal and the output terminal, the second switching element is connected between the output terminal and the signal line, and the third switching element is connected between the inversion terminal and the signal line. The sensing controller turns on the first and second switching elements and turns off the third switching element during a first period, turns off the first and second switching elements and turns on the third switching element during a second period, and changes the data stored in the holding latch based on a voltage of the output terminal.

The sensing controller may store data corresponding to a voltage of the signal line in the holding latch by repeating operations of selecting a bit to be set in the holding latch and setting a value of the selected bit based on the voltage of the output terminal, after resetting the data stored in the holding latch as a predetermined value during the second period.

The sensing controller may select the bit to be set in the holding latch from a most significant bit (MSB) to a least significant bit (LSB) in sequence.

The data driving apparatus may further include a fourth switching element and a fifth switching element. The fourth switching element may be turned off during the first period and turned on during the second period to transfer the voltage of the output terminal to the level down converter. The fifth switching element may be turned off during the first period and turned on during the second period to transfer the down-converted voltage to the holding latch.

The holding latch may output data stored during the second period according to a control of the sensing controller.

Yet another embodiment of the present inventive concept provides a display device. The display device includes a pixel; a signal line connected to the pixel to transfer the data voltage; a holding latch storing input data; a digital analog converter converting a digital output of the level shifter to an analog data voltage; an operational amplifier; and a sensing controller. The operational amplifier operates as a buffer which outputs the analog data voltage of the digital analog converter to the signal line during a display period, and operates as a comparator which compares a voltage of the signal line with the analog data voltage of the digital analog converter during a sensing period. The sensing controller controls the holding latch to change data stored in the holding latch according to a comparison value of the comparator.

The holding latch may output data stored during the sensing period according to the control of the sensing controller.

The holding latch may store data corresponding to the voltage of the signal line by repeating a comparing operation of the comparator and an operation of changing the data stored in the holding latch.

The sensing controller may store the data corresponding to a voltage of the signal line in the holding latch by repeating operations of selecting a bit to be set in the holding latch and setting a value of the selected bit according to the comparison value, after resetting the data stored in the holding latch as a predetermined value during the sensing period.

DETAILED DESCRIPTION OF THE EMBODIMENTS

Figure 1:
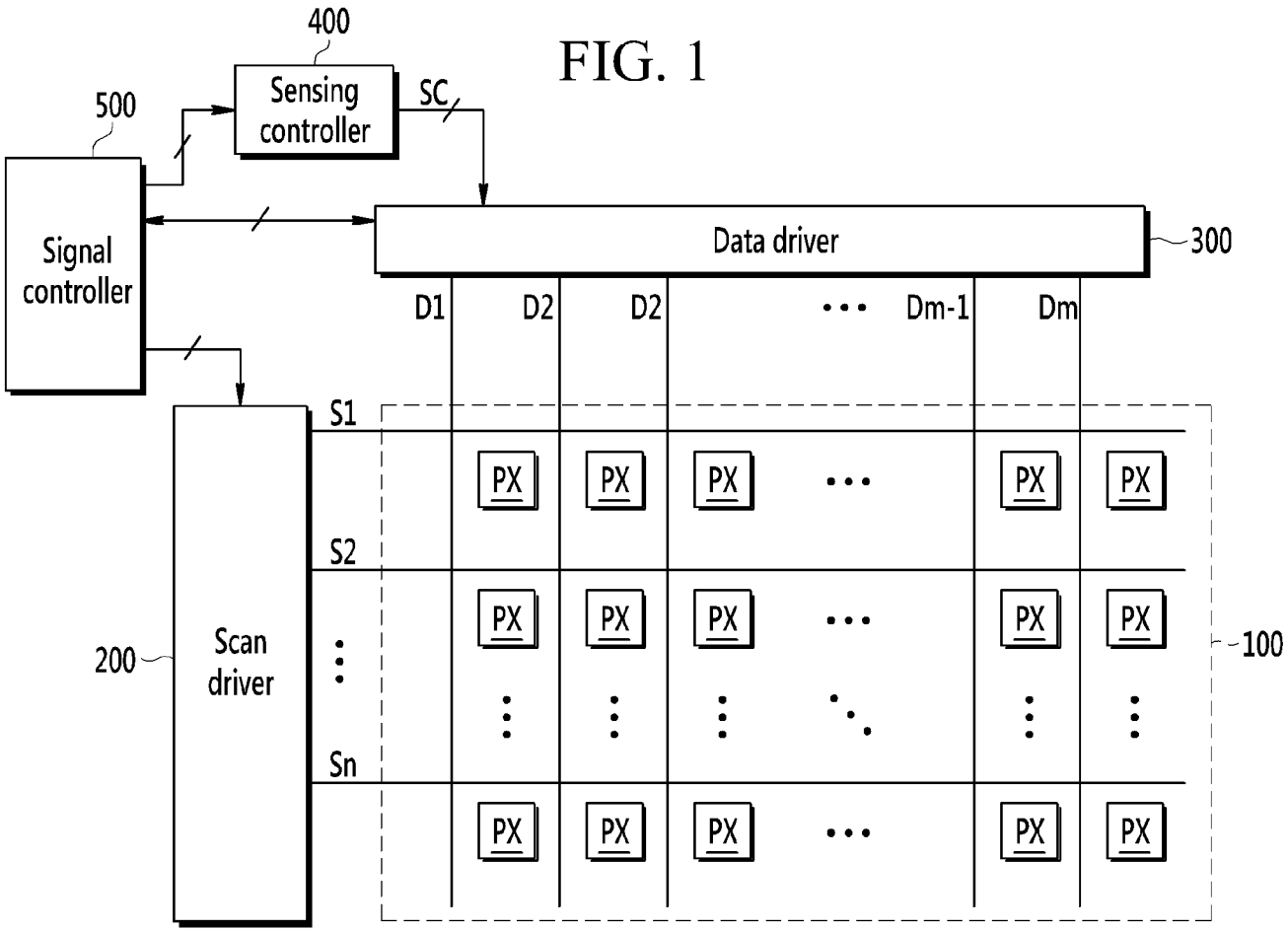
FIG. 1 is a block diagram of a display device according to an embodiment of the present inventive concept.

In the following detailed description, only certain embodiments of the present inventive concept have been shown and described, simply by way of illustration. As those skilled in the art would realize, the described embodiments may be modified in various different ways, all without departing from the spirit or scope of the present inventive concept. Accordingly, the drawings and description are to be regarded as illustrative in nature and not restrictive. Like reference numerals designate like elements throughout the specification.

FIG. 1 is a block diagram of a display device according to an embodiment of the present inventive concept.

Referring to FIG. 1, a display device includes a display unit 100, a scan driver 200 and a data driver 300 connected to the display unit 100, a sensing controller 400, and a signal controller 500 controlling the scan driver 200, the data driver 300 and the sensing controller 400.

The display unit 100 includes a plurality of display signal lines S1-Sn and D1-Dm and a plurality of pixels PXs connected to the plurality of display signal lines S1-Sn and D1-Dm and arranged substantially in a matrix form. The display unit 100 may include lower display panel. The display unit 100 may further include an upper display panel (not shown) facing the lower display panel.

The display signal lines S1-Sn and D1-Dm include a plurality of scan lines S1-Sn for transferring scan signals (referred to as "gate signals") and a plurality of data lines D1-Dm for transferring data signals. The scan lines S1-Sn extend substantially in a row direction and are substantially parallel to each other, and the data lines D1-Dm extend substantially in a column direction and are substantially parallel to each other.

The pixel PX may include a transistor (not shown) that has a gate connected to the scan line and a source/drain connected to the data line and that transfers a data signal from the data line in response to a gate-on voltage from the scan line. The pixel may further include a light emitting area (not shown) expressing the grayscale according to the data signal from the transistor. In the case where the display device is an organic light emitting display device, the emission area may include a capacitor storing the data signal, a driving transistor for transferring a current according to the data signal stored in the capacitor, and an organic light emitting diode (OLED) for expressing the grayscale according to the current from the driving transistor.

The scan driver 200 applies a scan signal which includes a combination of a gate-on voltage and a gate-off voltage to the scan lines S1-Sn according to a control signal from the signal controller 500. The gate-on voltage is a voltage applied to the gate of the transistor to turn on the transistor, and the gate-off voltage is a voltage applied to the gate of the transistor to turn off the transistor.

The data driver 300 generates data signal, i.e., data voltages representing the grayscales of the pixels PXs according to input data from the signal controller 500 and applies the data signals to the data lines D1-Dm. Further, the data driver 300 detects voltages applied to the data lines D1-Dm.

The sensing controller 400 outputs a sensing control signal SC to control whether the data driver 300 performs an operation of applying the data signal to the data lines D1-Dm or performs an operation of sensing the voltage applied to the data lines D1-Dm. The sensing controller 400 may be formed separately from the signal controller 500 or included in the signal controller 500.

The signal controller 500 controls operations of the scan driver 200 and the data driver 300. Further, the signal controller 500 determines a compensation value for compensating for differences in luminance of the pixels due to degradation of the organic light emitting diode based on the current sensed in the sensing controller 400 and corrects the input data based on the compensation value.

Each of the drivers and controllers 200, 300, 400, and 500 may be directly mounted on the display unit 100 in at least one IC chip form, mounted on a flexible printed circuit film (not illustrated) to be attached to the display unit 100 in a tape carrier package (TCP) form, or mounted on a separate printed circuit board (not illustrated) and connected to the display unit 100 using a connector. Alternatively, the drivers and controllers 200, 300, 400, and 500 may be integrated on the display unit 100 when forming the signal lines S1-Sn and D1-Dm, and/or the transistor. Further, the drivers or controllers 200, 300, 400, and 500 may be integrated into a single chip. At least one of the drivers or controllers, or at least one circuit element forming the drivers or controllers may be integrated into another chip.

When the sensing controller 400 outputs a display control signal DC, the data driver 300 generates data voltages according to the input data from the signal controller 500 and applies the generated data voltages to the data lines D1-Dm. When the sensing controller 400 outputs the sensing control signal SC, the data driver 300 senses the voltages of the data lines D1-Dm and transfers digital values corresponding to the sensed voltages to the signal controller 500. The signal controller 500 compensates for the input data according to the digital values.

Figure 2:
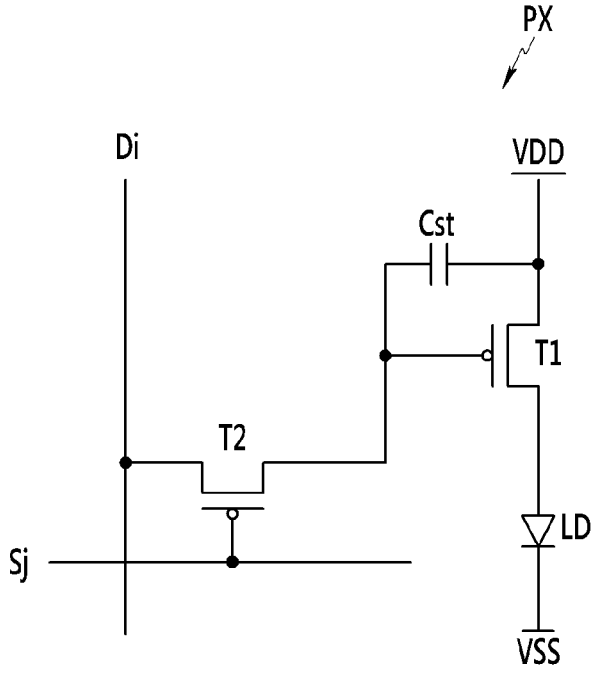
FIG. 2 is a diagram illustrating an example of a pixel of the display device according to an embodiment of the present inventive concept.

FIG. 2 is a diagram illustrating an example of a pixel of the display device according to an embodiment of the present inventive concept.

Referring to FIG. 2, one example of the pixel PX includes transistors T1 and T2, a capacitor Cst, and an organic light emitting diode LD.

The driving transistor T1 has a control terminal, an input terminal, and an output terminal, and the switching transistor T2 also has a control terminal, an input terminal, and an output terminal.

In the driving transistor T1, the input terminal is connected to a power supply VDD, and the output terminal is connected to one terminal of the organic light emitting diode LD. The other terminal of the organic light emitting diode LD is connected to a power supply VSS.

In the switching transistor T2, the control terminal is connected to a scan line Sj, the input terminal is connected to a data line Di, and the output terminal is connected to the control terminal of the driving transistor T1.

In the capacitor Cst, one terminal is connected to the output terminal of the switching transistor T2, that is, the control terminal of the driving transistor T1, and the other terminal is connected to the power supply VDD.

Accordingly, when the switching transistor T2 is turned on in response to the scan signal from the scan line Sj, the data signal (the data voltage) from the data line Di is charged in the capacitor Cs. The driving transistor T1 outputs the current corresponding to the voltage charged in the capacitor Cs, and the organic light emitting diode LD emits light according to the current, thereby expressing the grayscale.

Figure 3:
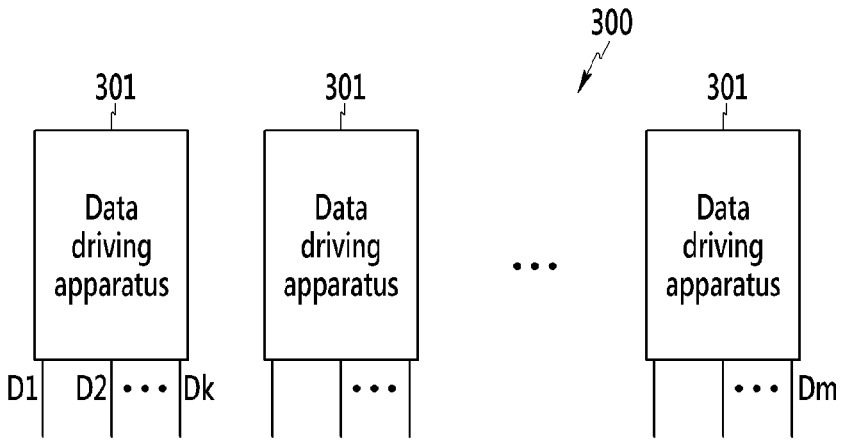
FIG. 3 is a block diagram of a data driver according to an embodiment of the present inventive concept.
Figure 4:
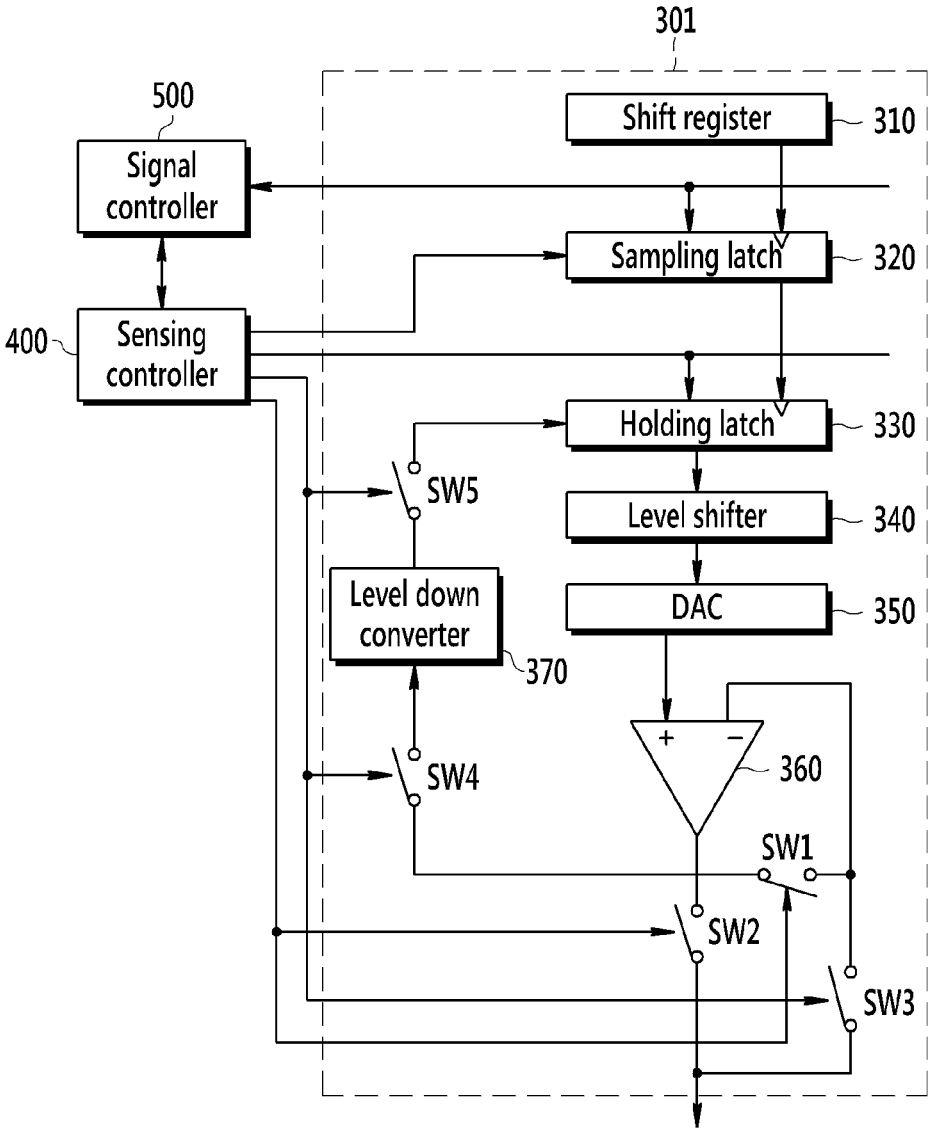
FIG. 4 is a block diagram of a data driving apparatus according to an embodiment of the present inventive concept.
Figure 5:
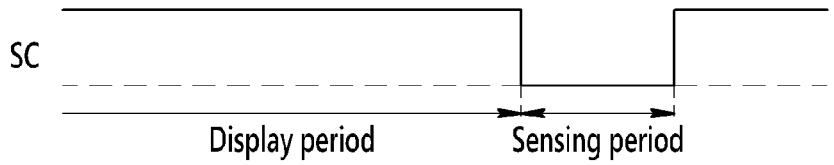
FIG. 5 is a diagram illustrating an example of a sensing control signal according to an embodiment of the present inventive concept.
Figure 6:
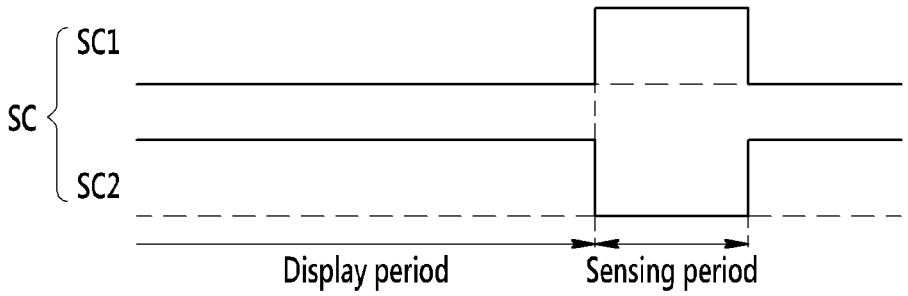
FIG. 6 is a diagram illustrating another example of a sensing control signal according to an embodiment of the present inventive concept.

FIG. 3 is a block diagram of a data driver according to an embodiment of the present inventive concept, FIG. 4 is a block diagram of a data driving apparatus according to an embodiment of the present inventive concept, and FIGS. 5 and 6 are diagrams illustrating an example of a sensing control signal according to an embodiment of the present inventive concept.

Referring to FIG. 3, the data driver 300 includes a plurality of data driving apparatuses 301 corresponding to a plurality of channels, respectively. The plurality of data driving apparatuses 301 may be data driver ICs. In this case, the plurality of data lines D1-Dm of the display unit 100 may be grouped to correspond to the plurality of channels. Each channel may include a predetermined number of data lines. Accordingly, each data driving apparatus 301 is connected to the data line of the corresponding channel and applies the data voltage to the data line or senses the voltage of the data line.

Referring to FIG. 4, the data driving apparatus 301 includes a shift register 310, a sampling latch 320, a holding latch 330, a level shifter 340, a digital analog converter (DAC) 350, a buffer unit 360 which may be an operational amplifier, a level down converter 370, and a plurality of switching elements SW1 to SW5.

The data driving apparatus 301 is connected to a predetermined number of data lines (for example, D1-Dk) corresponding to its own channel among the plurality of data lines D1-Dm. Input data corresponding to the predetermined number of data lines D1-Dk may be sequentially input to the data driving apparatus 301 from the signal controller.

The shift register 310 generates sampling signals and shifts the generated sampling signals in sequence, thus transfers the sampling signals to the sampling latch 320. The sampling latch 320 samples the input data sequentially input according to the sampling signals and stores the sampled data in the holding latch 330.

For example, the shift register 310 generates the sampling signals according to an activation signal and sequentially shifts and outputs the sampling signals in synchronization with a clock to the sampling latch 320. In this case, the sampling signals may be generated by a predetermined number so as to correspond to the predetermined number of data lines D1-Dk connected to the data driving apparatus 301. The sampling latch 320 sequentially samples the input data in response to the sampling signals. In this case, an i-th sampling signal may sample the input data corresponding to the i-th data line Di. Next, the holding latch 330 holds the input data sequentially sampled in the sampling latch 320 until all the input data for one row are sampled and then simultaneously outputs the sampled input data to the level shifter 340.

The level shifter 340 shifts a voltage level of the input data output from the holding latch 330. For example, the level shifter 340 may increase a voltage level of the input data output from the holding latch 330. The DAC 350 converts the digital input data of which the level is shifted in the level shifter 340 into an analog data voltage Vdata.

The buffer unit 360 temporarily stores and outputs the voltage transferred from the DAC 350. The data driving apparatus 301 may include a predetermined number of buffer units which correspond to the predetermined number of data lines D1-Dk, respectively. The buffer unit 360 has a non-inversion input terminal receiving the voltage transferred from the DAC 350. The buffer unit 360 may be operated as a unity gain operational amplifier during a display period when the data voltage Vdata is applied to the display unit 100 to express the gray scale and may be operated as a comparator during a sensing period when the voltage of the data line is sensed.

A plurality of switching elements SW1, SW2, SW3, SW4, and SW5 are turned on or off according to the sensing control signal SC from the sensing controller 400 to control the operation of the data driving apparatus 301.

The switching element SW1 is connected between an inversion input terminal of the buffer unit 360 and an output terminal of the buffer unit 360, and the switching element SW2 is connected between an output terminal of the buffer unit 360 and the data line Di. Two switching elements SW1 and SW2 are turned on during the display period and turned off during the sensing period in response to the sensing control signal SC. The buffer unit 360 operates as a unity gain operational amplifier by connecting the inversion input terminal of the buffer unit 360 and the output terminal of the buffer unit 360 by the turned-on switching element SW1. Further, the output terminal of the buffer unit 360 is connected to the data line Di through the turned-on switching element SW2, and the data voltage Vdata from the DAC 350 is applied to the data line Di through the buffer unit 360.

The switching element SW3 is connected between the inversion input terminal of the buffer unit 360 and the data line Di. The switching element SW4 is connected between an input terminal of the level down converter 370 and the output terminal of the buffer unit 360, and the switching element SW5 is connected between an output terminal of the level down converter 370 and the holding latch 330. Three switching elements SW3, SW4, and SW5 are turned on during the sensing period and turned off during the display period in response to the sensing control signal SC. The sensing signal SC may include one signal but the sensing control signal SC may include a first sensing signal SC1 and a second sensing signal SC2 which is inverted signal of the first sensing signal SC1. The inversion input terminal of the buffer unit 360 and the data line Di are connected to each other by the turned-on switching element SW3 and thus the buffer unit 360 operates as an open loop comparator. Accordingly, the buffer unit 360 compares a sensing voltage Vsen sensed in the data line Di with the voltage output from the DAC 350 to output the sensing voltage to the output terminal of the buffer unit 360.

The input terminal of the level down converter 370 receives the output terminal voltage of the buffer unit 360 through the switching element SW4. The level down converter 370 down-converts the received voltage and transfer the level-down voltage which is lower than the output voltage of the buffer unit 360 to the holding latch 330 through the switching element SW5. The holding latch 330 stores the transferred voltage. The holding latch 330 may store a value corresponding to the sensing voltage Vsen by repeating the above operations.

According to some embodiments, the switching elements SW1 and SW2, and the switching elements SW3, SW4, and SW5 may be formed as transistors having different majority carrier. In this case, the switching elements SW1 and SW2 and the switching elements SW3, SW4, and SW5 may be controlled by one sensing control signal SC. For example, when the switching element SW1 and SW2 are formed as n-channel transistors and the switching elements SW3, SW4, and SW5 are formed as p-channel transistors, as shown in FIG. 5, the sensing control signal SC has a high level during the display period and a low level during the sensing period.

According to some embodiments, all of the switching elements SW1, SW2, SW3, SW4, and SW5 may be formed as transistors having the same majority carrier. In this case, the sensing control signal SC includes a first control signal SC1 controlling the switching elements SW1 and SW2 and a second control signal SC2 controlling the switching elements SW3, SW4, and SW5. For example, when the switching elements SW1, SW2, SW3, SW4, and SW5 are formed as p-channel transistors, as shown in FIG. 6, the first control signal SC1 has a low level and the second control signal SC2 has a high level during the display period, and the first control signal SC1 has a high level and the second control signal SC2 has a low level during the sensing period.

According to some embodiments, the sensing period may be set to a period except for the display period when the display unit 100 displays the image. For example, a blank period between frames may be set as the sensing period. Alternatively, a period when the display device ends the display operation and is in a stand-by state or a predetermined period from the time when the power of the display device is turned off may be set as the sensing period.

Figure 7:
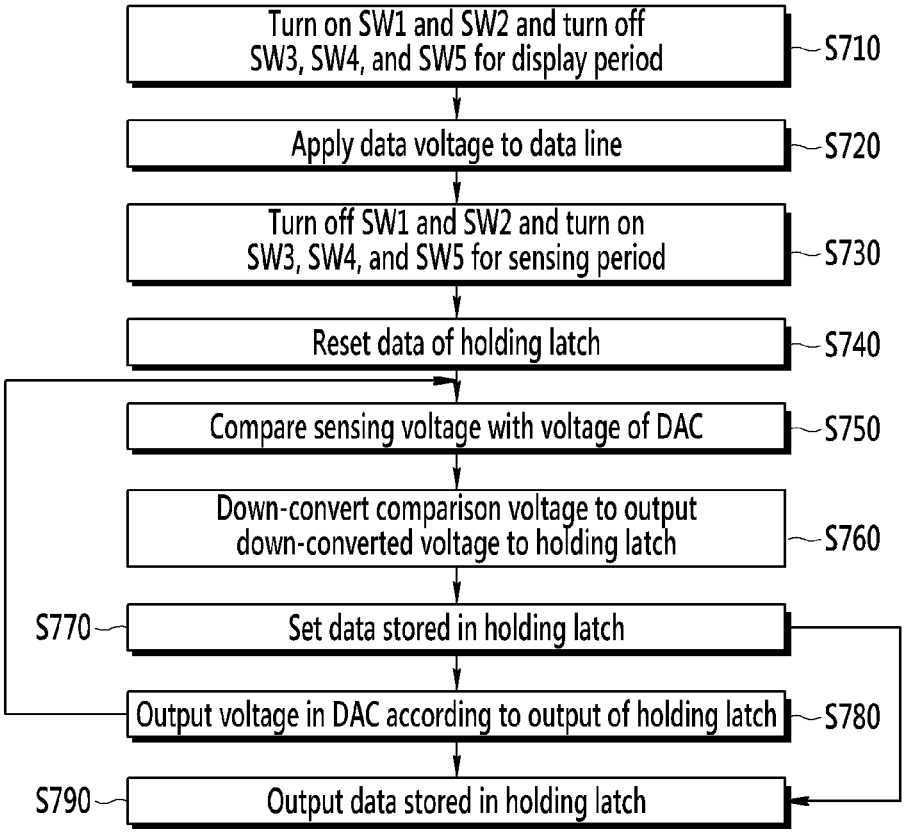
FIG. 7 is a flowchart of a compensation method according to an embodiment of the present inventive concept.
Figure 8:
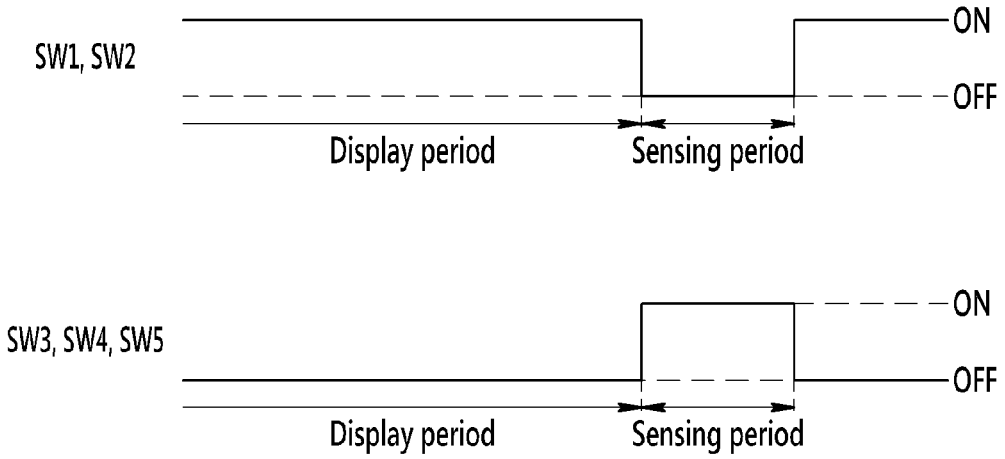
FIG. 8 is a diagram illustrating an operation of a switching element of a data driving apparatus according to an embodiment of the present inventive concept.

FIG. 7 is a flowchart of a compensation method according to an embodiment of the present inventive concept, and FIG. 8 is a diagram illustrating an operation of a switching element of a data driving apparatus according to the embodiment of the present inventive concept.

Referring to FIGS. 7 and 8, during the display period, the sensing controller 400 outputs the sensing control signal SC which turns on the switching elements SW1 and SW2 of the data driving apparatus 301 and turns off the switching elements SW3, SW4, and SW5 (S710). During the display period, the signal controller 500 transfers the input data to the data driving apparatus 301, and the data driving apparatus 301 generates the data voltage using the input data.

In this case, the buffer unit 360 operates as a buffer by the turned-on switching elements SW1 and SW2. Accordingly, the data driving apparatus 301 generates data voltage using the input data and applies the data voltage to the data line through the buffer unit 360 (S720). Then, the pixel PX of the display unit 100 writes the data voltage from the data line on the capacitor Cst and expresses the grayscale corresponding to the data voltage.

Next, during the sensing period, the sensing controller 400 outputs the sensing control signal SC which turns off the switching elements SW1 and SW2 of the data driving apparatus 301 and turns on the switching elements SW3, SW4, and SW5 (S730). Further, the sensing controller 400 resets the data stored in the holding latch 330 to a predetermined value, and the holding latch 330 outputs the reset data (S740). Accordingly, the level shifter 340 shifts the level of the data output from the holding latch 330 and DAC 350 converts the digital data to the analog voltage. In this case, by the turned-on switching element SW3, the buffer unit 360 operates as a comparator. Accordingly, the buffer unit 360 compares the analog voltage output from the DAC 350 with the voltage (that is, the sensing voltage) applied to the data line and outputs a comparison voltage corresponding to the comparison result (S750).

The level down converter 370 down-converts the comparison voltage into a voltage of a level capable of being used in the holding latch 330 to output the down-converted voltage to the holding latch 330 (S760). The holding latch 330 changes the data stored according to the output of the level down converter 370 and the control of the sensing controller 400 and outputs the changed data to the level shifter 340 (S770). The level shifter 340 changes the level of the value output from the holding latch 330, and the DAC 350 converts and outputs the output of the level shifter 340 into the analog voltage (S780).

Then, the buffer unit 360 operating as the comparator compares the sensing voltage with the output voltage of the DAC 350 again and outputs the comparison voltage to the level down converter 370 (S750). As such, by repeating the operations of steps S750 to S780, the voltage (that is, the output voltage of the DAC 350) input to the non-inversion terminal of the buffer unit 360 is close to the sensing voltage Vsen. Eventually, the digital data corresponding to the sensing voltage Vsen is stored in the holding latch 330.

Next, the holding latch 330 transfers the data stored according to the control of the sensing controller 400 to the signal controller 500 (S790). In an embodiment, the holding latch 330 outputs the data stored according to the control of the sensing controller 400 to the sampling latch 320, and the sampling latch 320 may transfer the data received from the holding latch 330 according to the control of the sensing controller 400 to the signal controller 500. In this case, in the sampling latch 320, the data may be transferred through a path used to receive the input data from the signal controller 500. In another embodiment, the holding latch 330 may directly transfer the data stored according to the control of the sensing controller 400 to the signal controller 500.

Accordingly, the signal controller 500 may compensate for the input data based on the digital data corresponding to the sensing voltage Vsen.

As such, according to the embodiment of the present inventive concept, it is possible to generate the digital data for compensation by using the holding latch, the operational amplifier, and the like of the data driving apparatus, without using a separate analog-digital converter.

Next, a method of setting the data of the holding latch 330 in the sensing controller 400 for the sensing period will be described with reference to FIG. 9.

Figure 9:
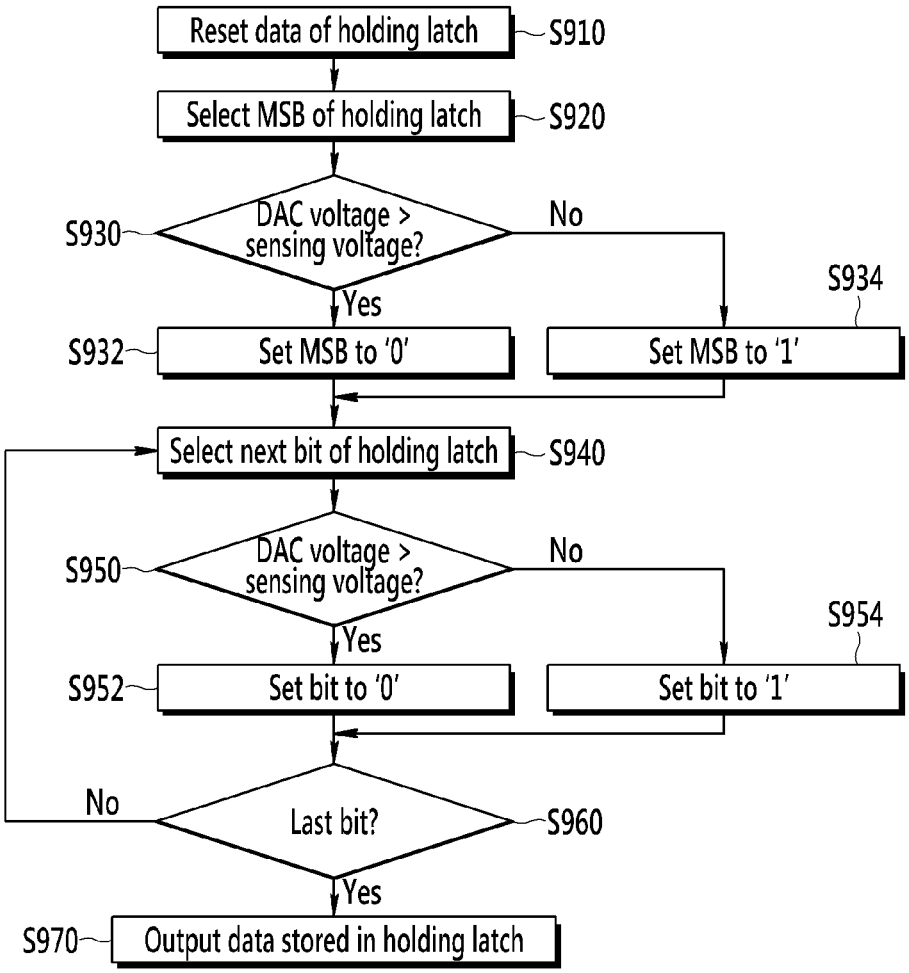
FIG. 9 is a flowchart of a method of setting holding latch data according to an embodiment of the present inventive concept.

FIG. 9 is a flowchart of a method of setting holding latch data according to an embodiment of the present inventive concept. In FIG. 9, it is assumed that the holding latch 330 stores data of 8 bits for one data line.

Referring to FIG. 9, the sensing controller 400 resets the data of the holding latch 330 to a predetermined value (S910). For example, the sensing controller 400 may reset the data of the holding latch 330 to '10000000'. In this case, '10000000' corresponds to a medium value of the data which may be stored in the holding latch 330.

The sensing controller 400 sets the holding latch 330 to control a most significant bit (MSB) among 8 bits of the holding latch 330 (S920). In addition, the holding latch 330 controls the MSB value according to the comparison result between the voltage of the DAC 350 of the buffer unit 360 operating as the comparator and the sensing voltage Vsen (S930). When the comparison result is a high-level voltage (that is, the voltage of the DAC 350 is higher than the sensing voltage Vsen), the holding latch 330 sets the MSB to '0' (S932), and when the comparison result is a low-level voltage (that is, the voltage of the DAC 350 is lower than the sensing voltage Vsen), the holding latch 330 sets the MSB to '1' (S934).

Next, the sensing controller 400 sets the holding latch 330 to control a next bit in the data of 8 bits of the holding latch 330 (S940). In addition, the holding latch 330 controls a bit value set according to the comparison result between the voltage of the DAC 350 of the buffer unit 360 operating as the comparator and the sensing voltage Vsen (S950). When the comparison result is a high-level voltage (that is, the voltage of the DAC 350 is higher than the sensing voltage Vsen), the holding latch 330 sets the corresponding bit to '0' (S952), and when the comparison result is a low-level voltage (that is, the voltage of the DAC 350 is lower than the sensing voltage Vsen), the holding latch 330 sets the corresponding bit to '1' (S954).

By repeating the process (S960), a value of each bit of the holding latch 330 is set to '1' or '0' and set up to a least significant bit (LSB), and thereafter, the data stored in the holding latch 330 correspond to the sensing voltage Vsen. In addition, after all the bits of the holding latch 330 are set, the sensing controller 400 outputs the data stored in the holding latch 330 to the signal controller 500 (S970). The signal controller 500 may compensate for the input data according to the data output from the holding latch.

While this inventive concept has been described in connection with what is presently considered to be practical embodiments, it is to be understood that the inventive concept is not limited to the disclosed embodiments, but, on the contrary, is intended to cover various modifications and equivalent arrangements included within the spirit and scope of the appended claims.

What is claimed is:

1. A data driving apparatus of a display device including a signal line connected to a pixel, the apparatus comprising:

a holding latch configured to store input data;

a digital analog converter configured to convert digital data output from the holding latch into an analog data voltage;

an operational amplifier configured to operate as a buffer which outputs the analog data voltage of the digital analog converter to the signal line during a display period and to operate as a comparator which compares a voltage of the signal line with the analog data voltage of the digital analog converter during a sensing period; and a sensing controller configured to control the holding latch to change data stored in the holding latch according to a comparison value of the comparator.

2. The data driving apparatus of claim 1, wherein the sensing controller is further configured to control whether the operational amplifier operates as the buffer or operates as the comparator.

3. The data driving apparatus of claim 2, wherein the holding latch is further configured to output data stored during the sensing period according to a control of the sensing controller.

4. The data driving apparatus of claim 1, further comprising:

a sampling latch configured to sample the input data transferred from a signal controller of the display device in response to a sampling signals and transfer the sampled input data to the holding latch; and a shift register configured to sequentially transfer the sampling signals to the sampling latch.

5. The data driving apparatus of claim 4, wherein the holding latch is further configured to output the data stored during the sensing period to the sampling latch, and the sampling latch is further configured to transfer the data received from the holding latch to the signal controller.

6. The data driving apparatus of claim 5, wherein a path on which the sampling latch transfers the data received from the holding latch to the signal controller is a same as a path on which the sampling latch receives the input data from the signal controller.

7. The data driving apparatus of claim 1, wherein the holding latch is further configured to store data corresponding to the voltage of the signal line by repeating a comparing operation of the comparator and an operation of changing the data stored in the holding latch.

8. The data driving apparatus of claim 1, wherein the sensing controller is further configured to store the data corresponding to the voltage of the signal line in the holding latch by repeating operations of selecting a bit to be set in the holding latch and setting a value of the selected bit according to the comparison value after resetting the data stored in the holding latch as a predetermined value during the sensing period.

9. The data driving apparatus of claim 8, wherein the sensing controller is further configured to select the bit to be set in the holding latch from a most significant bit (MSB) to a least significant bit (LSB) in sequence.

10. The data driving apparatus of claim 1, further comprising:

a level down converter configured to down-convert the comparison value of the comparator and transfer the down-converted value to the holding latch.

11. The data driving apparatus of claim 1, further comprising:

a level shifter configured to shift a level of the data output from the holding latch and transfer the level shifted data to the digital analog converter.

12. A data driving apparatus of a display device including a signal line connected to a pixel, the apparatus comprising:

a holding latch configured to store input data;

a digital analog converter configured to convert digital data output from the holding latch into an analog data voltage;

an operational amplifier having a non-inversion terminal for receiving an output of the digital analog converter, an inversion terminal, and an output terminal;

a first switching element connected between the inversion terminal and the output terminal;

a second switching element connected between the output terminal and the signal line;

a third switching element connected between the inversion terminal and the signal line; and a sensing controller configured to turn on the first and second switching elements and turn off the third switching element during a first period, to turn off the first and second switching elements and turn on the third switching element during a second period, and to change the data stored in the holding latch based on an voltage of the output terminal.

13. The data driving apparatus of claim 12, wherein the sensing controller is further configured to store data corresponding to a voltage of the signal line in the holding latch by repeating operations of selecting a bit to be set in the holding latch and setting a value of the selected bit based on the voltage of the output terminal, after resetting the data stored in the holding latch as a predetermined value during the second period.

14. The data driving apparatus of claim 13, wherein the sensing controller is further configured to select the bit to be set in the holding latch from a most significant bit (MSB) to a least significant bit (LSB) in sequence.

15. The data driving apparatus of claim 12, further comprising:

a fourth switching element configured to be turned off during the first period and turned on during the second period to transfer the voltage of the output terminal to the level down converter; and a fifth switching element configured to be turned off during the first period and turned on during the second period to transfer the down-converted voltage to the holding latch.

16. The data driving apparatus of claim 12, wherein the holding latch is further configured to output data stored during the second period according to a control of the sensing controller.

17. A display device, comprising:

a pixel;

a signal line connected to the pixel to transfer the data voltage;

a holding latch configured to store input data;

a digital analog converter configured to convert a digital output of the level shifter to an analog data voltage;

an operational amplifier configured to operate as a buffer which outputs the analog data voltage of the digital analog converter to the signal line during a display period and to operate as a comparator which compares a voltage of the signal line with the analog data voltage of the digital analog converter during a sensing period; and a sensing controller configured to control the holding latch to change data stored in the holding latch according to a comparison value of the comparator.

18. The display device of claim 17, wherein the holding latch is further configured to output data stored during the sensing period according to a control of the sensing controller.

19. The display device of claim 17, wherein the holding latch is further configured to store data corresponding to the voltage of the signal line by repeating a comparing operation of the comparator and an operation of changing the data stored in the holding latch.

20. The display device of claim 17, wherein the sensing controller stores the data corresponding to a voltage of the signal line in the holding latch by repeating operations of selecting a bit to be set in the holding latch and setting a value of the selected bit according to the comparison value, after resetting the data stored in the holding latch as a predetermined value during the sensing period.

* * * * *